US008011611B2

(12) United States Patent
Yoshimaru et al.

(10) Patent No.: US 8,011,611 B2
(45) Date of Patent: Sep. 6, 2011

(54) ROLL PAPER TYPE RECORDING MEDIUM TRANSPORTING MECHANISM AND IMAGE FORMING APPARATUS

(75) Inventors: Akito Yoshimaru, Kanagawa (JP); Yuichiro Maeyama, Kanagawa (JP); Yoshio Miyamoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 172 days.

(21) Appl. No.: 12/385,598

(22) Filed: Apr. 14, 2009

(65) Prior Publication Data

US 2009/0266926 A1 Oct. 29, 2009

(30) Foreign Application Priority Data

Apr. 23, 2008 (JP) ..... 2008-112466

(51) Int. Cl.
*B65H 23/06* (2006.01)

(52) U.S. Cl. ..... 242/421; 242/422.2; 242/422.4

(58) Field of Classification Search .... 242/396.6–396.8, 242/421, 422.2, 422.4
See application file for complete search history.

(56) References Cited

U.S. PATENT DOCUMENTS 4,151,900 A * 5/1979 Kirwan ..... 188/174
4,788,570 A 11/1988 Ogata et al.
4,963,930 A 10/1990 Yoshimaru et al.
6,408,757 B2 * 6/2002 Ogawa et al. ..... 101/480
6,435,446 B1 * 8/2002 Matsuzawa ..... 242/422.4

FOREIGN PATENT DOCUMENTS

JP 05-085747 11/1993
JP 2003-276264 9/2003
JP 2006-248683 9/2006

* cited by examiner

*Primary Examiner* — Sang Kim

(74) *Attorney, Agent, or Firm* — Harness, Dickey & Pierce, P.L.C.

(57) ABSTRACT

In a recording medium transporting mechanism, a flange member is attached on either side of a roll paper and the flange member has a diameter smaller than a maximum outer diameter of a roll paper. Support rollers support a corresponding one of the flange members in a rotatable manner. The support rollers are moveable along the axis of rotation of the roll paper. The sum of an outer diameter of corresponding one of the flange members and the support rollers is greater than a maximum outer diameter of the roll paper. A rewinding roller of at least a length equivalent to a distance between both sets of support rollers when the sets of support rollers are farthest apart is engaged with a support roller within the set of support rollers and can rotate the flange member in a rewinding direction over a desired amount of continuous time.

18 Claims, 3 Drawing Sheets

ROLL PAPER TYPE RECORDING MEDIUM TRANSPORTING MECHANISM AND IMAGE FORMING APPARATUS

CROSS-REFERENCE TO RELATED APPLICATIONS

The present application claims priority to and incorporates by reference the entire contents of Japanese priority document 2008-112466 filed in Japan on Apr. 23, 2008.

BACKGROUND OF THE INVENTION

1. Field of the Invention

The present invention relates to a recording medium transporting mechanism in which a roll paper is used as a recording medium and a sheet of paper is transported from the roll paper. The present invention also relates to an image forming apparatus, such as a printer, a plotter, a facsimile machine, and a copier, including the recording medium transporting mechanism.

2. Description of the Related Art

In electrophotographic image forming apparatuses, such as large-scale copiers and printers, and other printing devices that handle originals of drawings and the like in large sizes, such as A0 size and A1 size, a following mechanism is used when image formation is performed using a large-size recording medium, to achieve user-friendliness in handling of paper serving as the recording medium. In the mechanism, a roll paper is provided as the recording medium. A sheet of paper is dispensed from the roll paper, and the dispensed sheet of paper is transported towards an image forming section.

Typically, a plurality of roll papers of different paper qualities and paper sizes are mounted on a paper feeding unit of the image forming apparatus. Paper is selected based on a size of an original, and the selected paper is fed to a recording unit. The selected paper is dispensed from the roll paper. A cutter, disposed further upstream from a transfer position of an image carrier, cuts the dispensed paper based on a length of the original. An image is transferred onto the cut paper (sheet of paper). The transferred image is fixed onto the sheet of paper, and image formation is completed. In an actual operation, a reciprocal driving mechanism is provided in a conveying roller device that transports the paper dispensed from the roll paper. After the paper is cut by the cutter, to return a leading end of the roll paper to a standby position (a position further upstream than a paper merging section in which papers from each roll paper merge), the reciprocal driving mechanism is used to operate the conveying roller device in reverse and return the paper. A control operation such as this is performed to prevent occurrence of a multi-feeding state caused by leading ends of each paper disposed onto a shared conveying path from each roll paper interfering with one another at the paper merging section.

In this manner, the paper is once dispensed from the roll paper and cut to a required length by the cutter. The conveying roller device then operates in reverse and rewinds the leading end of the roll paper to a predetermined position. However, because the roll paper itself does not rotate in a reverse direction, a rewound portion of the paper remains in a bent state or a forcibly folded state between the roll paper itself and the conveying roller device. Deformation, such as a fold, is formed, causing white-out during image formation. Alternatively, wrinkles are formed due to moisture absorption, causing the paper to jam.

Therefore, in Japanese Utility Model Application Laid-open No. H5-85747, a configuration is proposed in which, after the paper dispensed from the roll paper is cut and the paper on the roll paper side is rewound, slack in the paper is prevented by the roll paper itself being rotated in reverse. Specifically, a paper feeding device includes a driving section and a drive transmitting section. The driving section can operate in a forward direction and a reverse direction, and is connected to a paper feed roller by a one-directional clutch. The drive transmitting section is connected to the driving section by a transmission path other than the one-directional clutch, and can be connected to and released from a gear of a roll paper holder. In the paper feeding device, the drive transmitting section includes a swinging component that is held to allow pivoting towards the gear of the roll paper holder. The swinging component axially supports a main gear that receives rotational torque from the driving section. The main gear meshes with the gear of the roll paper holder as a result of the swinging component pivoting towards the gear of the roll paper holder. The meshing between the main gear and the gear of the roll paper holder is released as a result of the swinging component pivoting in a reverse direction. However, in the proposed configuration, the roll paper rotates in reverse by driving force from a motor. Therefore, a configuration for performing the reverse rotation is required to be added. The proposed configuration is disadvantageous in that the configuration is structurally complex.

In Japanese Patent Application Laid-open No. 2006-248683, to similarly rewind slack in the paper by the roll paper being driven in reverse when the paper on the roll paper side is rewound after the paper dispensed from the roll paper is cut, a rotation load section and a one-directional transmitting section are provided. The rotation load section is provided on a shaft section of a spool that holds a paper core of the roll paper. The spool can rotate in a transporting direction and a rewinding direction. The one-directional transmitting section is provided within a gear train that transmits drive from a drive source to the rotation load section. The one-directional transmitting section does not transmit drive in the transporting direction of the roll paper and transmits only drive in the rewinding direction.

Conventionally, to hold the roll paper, a spool method or a flange method is used to handle roll papers in various sizes. The spool method used in Japanese Utility Model Application Laid-open No. H5-85747 and in Japanese Patent Application Laid-open No. 2006-248683, is disadvantageous in terms of poor user operability (extreme difficulty in handling) because a long spool is required to be passed through the paper core of the roll paper. However, the spool method is advantageous in that, when a rewinding mechanism and the like are provided, the roll paper itself can be easily driven by the drive transmitting mechanism being provided in the spool. Therefore, the spool method is effective when the rewinding mechanism is provided.

The flange method has very high user operability because the roll paper is held by flanges being inserted into the paper core from both sides, regardless of the size of the roll paper. However, only the following methods can be used to directly transmit driving force to the roll paper. In one method, a diameter of the flanges is set to be greater than a maximum outer diameter of the roll paper, and the driving force is transmitted to an outer diameter of the flanges. Alternatively, an edge of the paper serves as a base in a width direction when the paper is conveyed, and the driving force is transmitted to a flange on a side that is not the edge serving as the base. When the outer diameter of the flanges is increased, a machine size itself increases because of the increase in the diameter of the flange. Increasing the outer diameter of the flanges is disadvantageous in that one end of the roll paper is required to be lifted to set the roll paper. Layout is also restricted as a result of the flange diameter being increased. When the edge of the paper serves as the base in the width direction when the paper is conveyed, problems may occur in quality of conveyance, such as wrinkling, misalignment, and skewing, when a long paper is conveyed.

In Japanese Patent Application Laid-open No. 2003-276264 in which the flange method is used, a configuration is used in which a diameter of a flange member is made smaller than the maximum outer diameter of the roll paper by a plurality of receiving rollers being provided. The receiving rollers hold the flange member such as to rotate freely. The roll paper is rewound by the receiving rollers being rotated in reverse. In the configuration, a rewinding mechanism is mounted on one of the receiving rollers. Stored force of a coil spring in the rewinding mechanism is actualized when the roll paper is transported. When the roll paper is rewound, the flange member is rotated in the rewinding direction by repulsive force of the spring. When rewinding speed is constant, an amount of slipping in the receiving rollers cannot be prevented from increasing, because a ratio of the outer diameter of the roll paper and a diameter of the receiving rollers or the diameter of the flange member changes as a result of decrease in an amount of remaining roll paper. Moreover, an amount of rewinding is limited by a fully wound state of the coil spring during transport. Therefore, the roll paper cannot be rewound over a long distance.

SUMMARY OF THE INVENTION

It is an object of the present invention to at least partially solve the problems in the conventional technology.

According to an aspect of the present invention, there is provided a recording medium transporting mechanism including a roll paper including a core cylinder for winding a recording medium; a flange member attached on either side of the roll paper, the flange member having a diameter smaller than a maximum outer diameter of a roll paper; a plurality of sets of support rollers that supports a corresponding one of the flange members in a rotatable manner, at least one set of support rollers among the sets of support rollers is adapted to move in a longitudinal direction of the roll paper, and a sum of an outer diameter of corresponding one of the flange members and the support rollers is greater than a maximum outer diameter of the roll paper; a paper feed roller that dispenses a recording medium from the roll paper via the support rollers; and a rewinding roller of at least a length equivalent to a distance between both sets of support rollers when the sets of support rollers are farthest apart is engaged with a support roller within the set of support rollers and can rotate the flange member in a rewinding direction over a desired amount of continuous time.

According to another aspect of the present invention, there is provided an image forming apparatus that includes the above recording medium transporting mechanism.

According to still another aspect of the present invention, there is provided a recording medium transporting mechanism including roll paper means including a core cylinder for winding a recording medium; flange member means attached on either side of the roll paper means, the flange member means having a diameter smaller than a maximum outer diameter of a roll paper; a plurality of sets of support roller means that supports a corresponding one of the flange member means in a rotatable manner, at least one set of support roller means among the sets of support roller means is adapted to move in a longitudinal direction of the roll paper means, and a sum of an outer diameter of corresponding one of the flange member means and the support roller means is greater than a maximum outer diameter of the roll paper means; paper feed roller means that dispenses a recording medium from the roll paper means via the support roller means; and rewinding roller means of at least a length equivalent to a distance between both sets of support roller means when the sets of support roller means are farthest apart is engaged with a support roller means within the set of support roller means and can rotate the flange member means in a rewinding direction over a desired amount of continuous time.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are below described with reference to the attached drawings.

Figure 1:
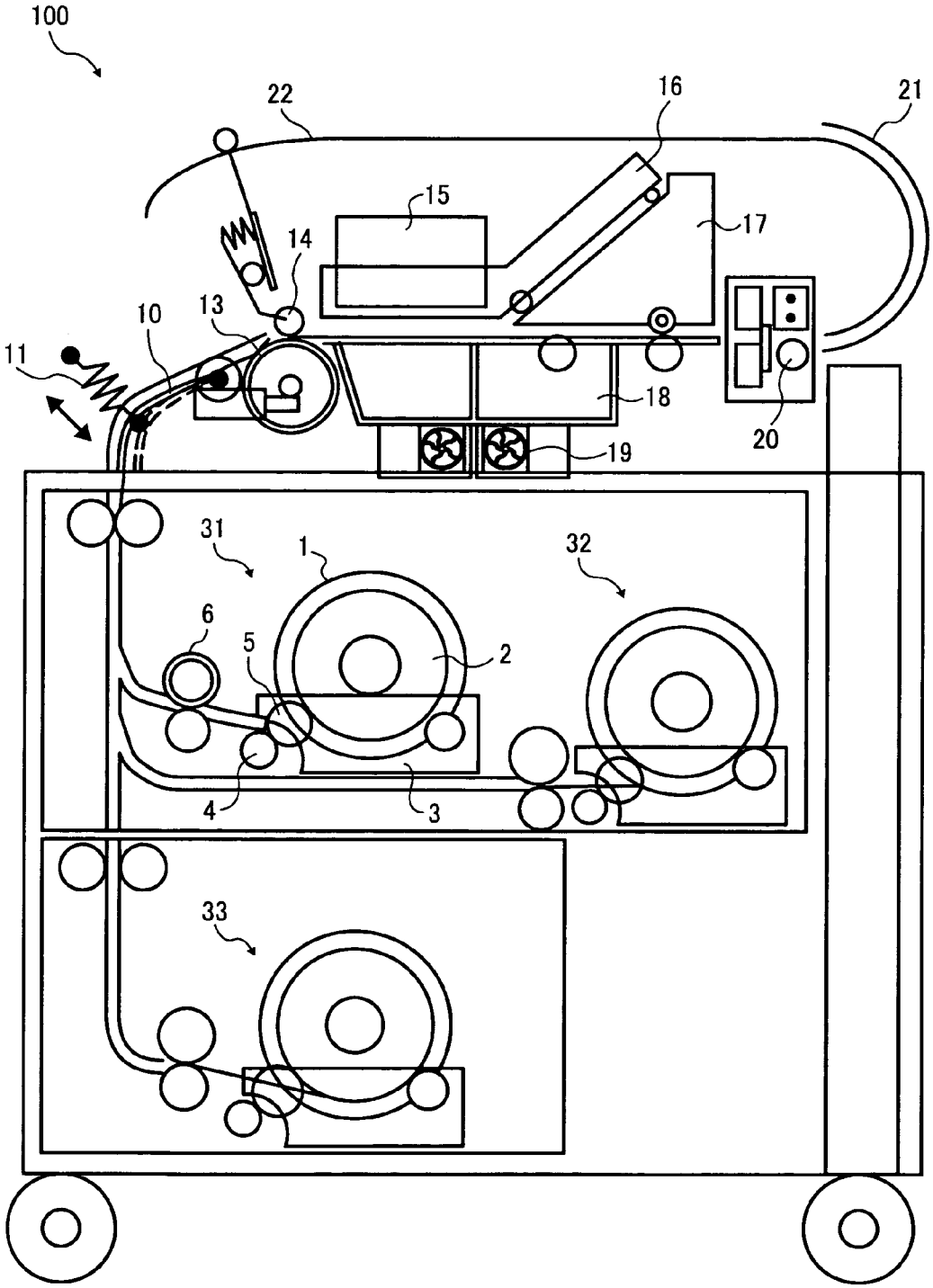
FIG. 1 is a schematic diagram of an image forming apparatus according to an embodiment of the present invention that uses roll papers.

In the following description, the present invention is applied to an inkjet printer; however, the present invention can be allied to any apparatus that uses roll papers. FIG. 1 is a schematic diagram of an overall configuration of an inkjet printer 100 according to an embodiment of the present invention. The inkjet printer 100 includes three roll paper feeders 31, 32, 33 that respectively serve as a paper transporting mechanism. The number of roll paper feeders is not limited to three; it can be less or more than three.

Figure 2:
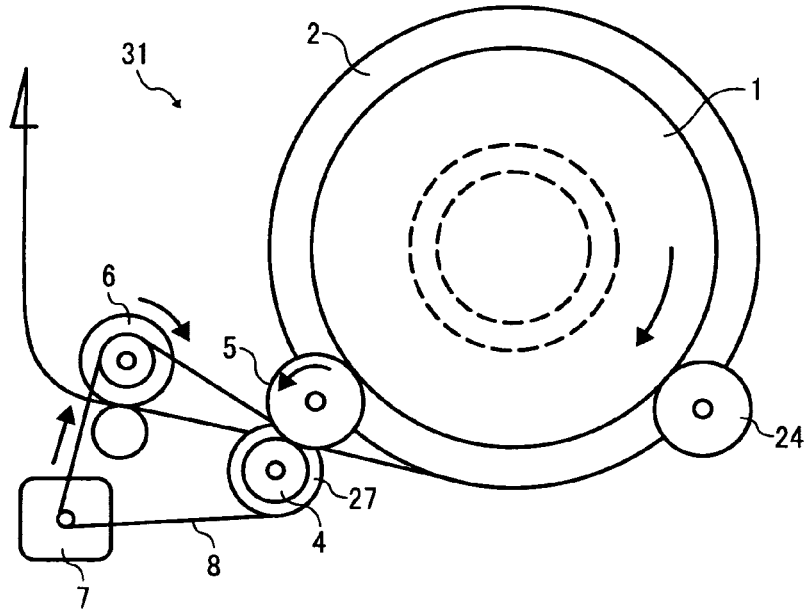
FIG. 2 is an enlarged front view of a paper feeder depicted in FIG. 1.
Figure 3:
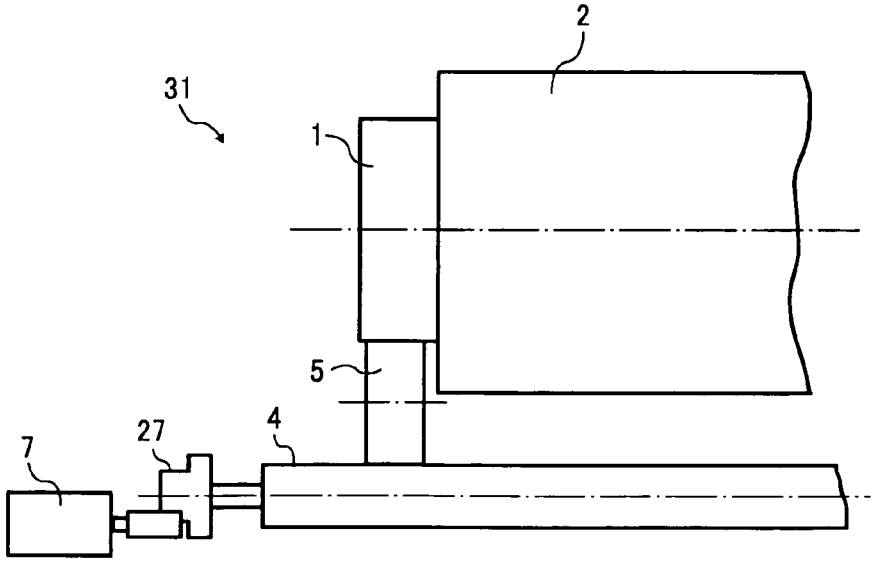
FIG. 3 is an enlarged side view of the paper feeder depicted in FIG. 1.

FIG. 2 is an enlarged front view of the paper feeder 31 and FIG. 3 is an enlarged side view of the paper feeder 31. The paper feeders 32 and 33 have almost the same structure as the paper feeder 31. Two flange members 1 are set in each roll feeder, one flange member 1 on each side of a paper core of a roll paper 2. An outer diameter of the flange member 1 is smaller than a maximum outer diameter (diameter of an unused roll paper) of the roll paper 2. The roll paper 2 with the flange members 1 attached thereto is set on a flange receiving base 3. Paper wound on the roll paper 2 is dispensed by a paper feed roller 6 and an opposing roller. The paper feed roller 6 is driven by a drive motor 7. The dispensed paper is conveyed to a paper tensioning section formed on a paper conveying path (see FIG. 1). The paper tensioning section basically includes a swingable conveying guide 10 and a spring 11, provided on an inner circumferential side. The paper tensioning section also provides a buffer function against tension applied to the dispensed paper. A sum of an outer diameter of corresponding one of the flange members and the support rollers is greater than a maximum outer diameter of the roll paper.

The paper is further conveyed between a resist roller 13 and a resist pressure roller 14 provided further downstream from the paper tensioning section. The paper is then conveyed onto a platen in a chamber 18 that serves as a printing section. Vacuum is generated within the chamber 18 by a suction fan 19 located below the chamber 18. The paper is suctioned onto the platen by a plurality of holes provided on the platen, thereby maintaining flatness of the paper.

A carriage 16 including a head 15 for ejecting ink is disposed above the platen. The carriage 16 moves to and fro in a width direction of the paper, along a main scanning stage 17, and ejects ink onto the paper on the platen. As a result, an image is formed on the paper. The resist roller 13 transports (intermittently conveys) the paper by a predetermined length by the resist roller 13 every time the carriage 16 moves, in correspondence with a width of the head 15. When image formation is completed, a cutter 20 cuts the paper to a predetermined length. The cut paper is conveyed along a reverse paper guide 21 and discharged onto a paper discharging tray 22.

Front rollers 5 and rear rollers 24 are provided on either side of the roll paper 2. The Front rollers 5 and rear rollers 24 are held rotatably by the flange receiving base 3. The flange member 1 rests on the front roller 5 and the rear roller 24. In this manner, the roll paper 2 is held rotatably by the flange receiving base 3.

The positions of the front rollers 5 and the rear rollers 24 in a longitudinal direction are adjustable. The positions of the front rollers 5 and the rear rollers 24 are adjusted depending on the size of the roll paper 2. The flange receiving base 3 is configured such that at least one pair of the front roller 5 and the rear roller 24 is movable in a longitudinal direction of the roll paper 2. The front roller 5 rotates by being in contact with a rewinding roller 4 merely moves in a sliding manner in the longitudinal direction. The rewinding roller 4 is longer than a width of a largest roll paper that wound around the core of the paper roll. Therefore, drive can still be stably transmitted even after a roll paper setting position on the flange receiving base is changed.

Thus, the front roller 5 is in contact with both the flange member 1 and the rewinding roller 4. A one-way clutch 27 is coupled to the rewinding roller 4. The one-way clutch 27 transmits drive via a roller (shown in FIG. 2 as a small diameter roller) that is concentric with the paper feed roller 6, the drive motor 7 that can operate in a forward direction and a reverse direction, and a timing belt 8. During rotation in the paper transporting direction, the one-way clutch 27 does not transmit the driving force from the drive motor 7 to the rewinding roller 4. During rotation in the rewinding direction, however, the one-way clutch 27 transmits the driving force from the drive motor 7 to the rewinding roller 4. The one-way clutch 27 can achieve optimal back tension during paper rewinding and enhance rewinding accuracy. The driving force of the drive motor 7 is transmitted to the rewinding roller 4 and the paper feed roller 6 with the timing belt 8. Alternatively, the driving force of the drive motor 7 can be transmitted to the rewinding roller 4 and the paper feed roller 6 by using a gear train.

When the paper is to be fed, the drive motor 7 and the timing belt 8 rotate in the forward direction. As a result, the paper feed roller 6 rotates in the clockwise direction (see FIG. 2), the front roller 5 rotates in the counter-clockwise direction, and the roll paper 2 and the flange member 1 rotate in the clockwise direction rotation. However, the one-way clutch 27 does not transmit the forward rotation of the drive motor 7 and the timing belt 8 to the rewinding roller 4. Therefore, the rewinding roller 4 does not rotate in a direction counter to the counter-clockwise rotation of the front roller 5. Basically, the rewinding roller 4 rotates such as to follow the front roller 5. Slight slippage is generated between the front roller 5 and the rewinding roller 4, and between the front roller 5 and the flange member 1. Therefore, slack in the paper between the paper feed roller 6 and the roll paper 2 does not occur. The arrows in FIG. 2 denote directions of rotation or movement of corresponding components when the paper is to be fed.

On the other hand, when the paper is to be rewound, the drive motor 7 and the timing belt 8 rotate in reverse direction depicted in FIG. 2. The paper feed roller 6 is rotated in the counter-clockwise direction. The one-way clutch 27 transmits the driving force to the rewinding roller 4. Therefore, the rewinding roller 4 also rotates in the counter-clockwise direction, and the front roller 5 rotates in the clockwise direction. The flange member 1 rotates in the counter-clockwise direction with the rotation of the front roller 5. The roll paper 2 also rotates in the counter-clockwise direction. The leading end of the paper dispensed from the roll paper 2 returns from the cutter 20 to a predetermined standby position. Two standby positions are provided. Ordinarily, the standby position that in which the paper is sandwiched between the resist roller 13 and the resist pressure roller 14. When image formation is successively performed using a paper of another size, the standby position is located further upstream from the paper merging section at which the papers from each roll paper merge. A sensor (not shown) recognizes when the leading end of the paper has reached the standby position.

When the paper is rewound, the paper feed roller 6 and the rewinding roller 4 basically rotate at a constant speed. However, the diameter of the roll paper 2 that is rotated by the rotation of the rewinding roller 4, via the front roller 5 and the flange member 1, becomes smaller with time (with use). An amount of rewinding (length of rewinding) gradually decreases. In other words, the amount of rewinding per rotation increases as the outer diameter of the roll paper 2 increases. Therefore, when a relative size of each rotating member is set such that slack in the paper does not occur as a result of the rotation of the paper feed roller 6, the rewinding roller 4, the front roller 5, and the flange member 1 when rewinding is performed when the amount of remaining roll paper 2 is small, a paper length that is longer than a rewinding amount dependent on a rotation amount of the paper feed roller 6 and the rewinding roller 4 can be rewound by the rotation of the roll paper 2 when the diameter of the roll paper 2 is large. Friction-sliding occurs between the rewinding roller 4, the front roller 5, and the flange member 1. The paper is rewound while friction-sliding at the paper feed roller 6, as well.

Magnetic force can be applied between an outer perimeter of the front roller 5 or the rear roller 24, or both the front roller 5 and the rear roller 24, and the outer perimeter of the flange member 1. Magnetic force can also be applied between the front roller 5 and the rewinding roller 4. Specifically, a configuration can be considered in which, for example, the front roller 5 and the rear roller 24 are made of a magnetic material. The rewinding roller 4 is made of steel, and steel is wrapped around the outer perimeter of the flange member 1. With such a configuration, contact is consistently maintained between the flange member 1, the front roller 5, the rear roller 24, and the rewinding roller 4. Uneven rotation and uneven conveyance of the paper during rewinding and transporting caused by bouncing and rebounding of the flange member 1 can be prevented. A stable paper conveyance performance can be maintained.

Figure 4:
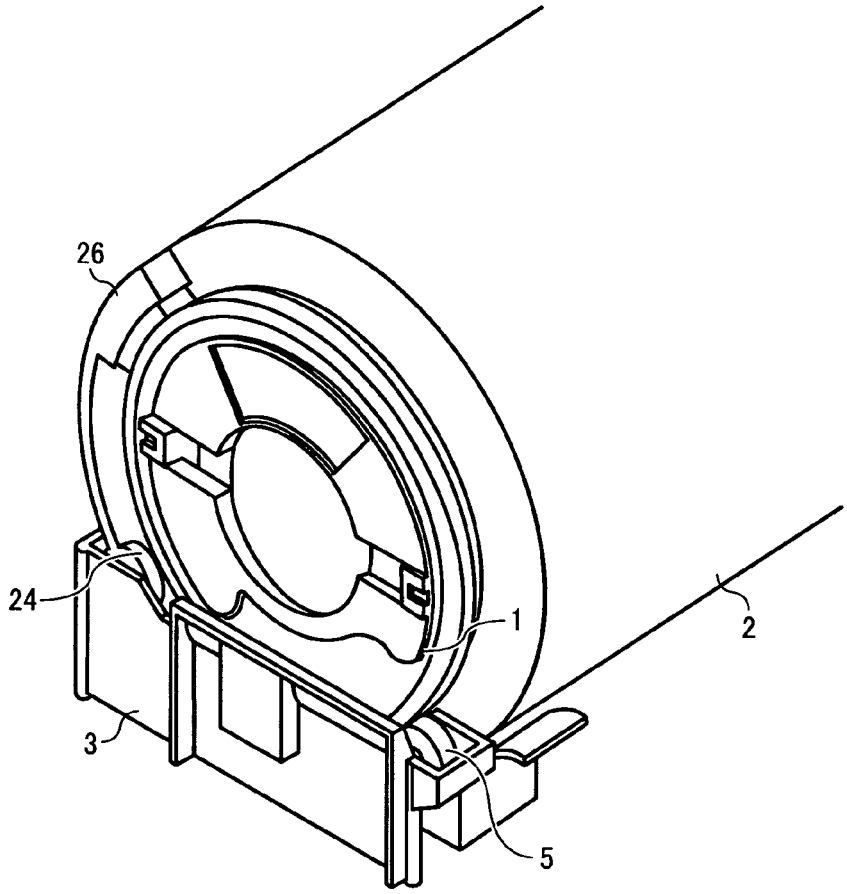
FIG. 4 is a partial perspective view of a configuration in which a brake for controlling rotation of a roll paper is provided to a flange member.

As described above, intermittent conveyance is performed when the paper is dispensed. At this time, a situation can be expected in which a heavy roll paper rotates too far. To prevent slack in the paper in this situation, a roll paper rotation controller is added. In FIG. 4, a brake shoe 26 that is an external drum brake is provided such as to cover a portion of an outer circumferential surface of the flange member 1. When braking is applied, the brake shoe 26 is pressed onto the outer perimeter of the flange member 1 by a solenoid and the like. Because the flange member 1 has a smaller outer diameter than the maximum outer diameter of the roll paper 2, providing the external drum brake, shown in FIG. 4, or an internal expanding brake within the flange member 1 as the rotation controller can be considered. However, a configuration of the flange member 1 can be changed, and a disk section can be formed some distance away from a portion coming into contact with the roll paper 2. As a result, a disk-brake type rotation controller can be formed. Configuration of the rotation controller is not limited. A brake controlling section (not shown) can be connected to the rotation controller, thereby allowing appropriate control of braking intensity and timing. In other words, the brake can be released when the paper is transported and rewound. The brake can be applied when the paper is stopped, and the roll paper 2 can be immediately stopped. With such a configuration, load applied to a motor can be reduced, and energy efficiency can be improved.

Figure 5:
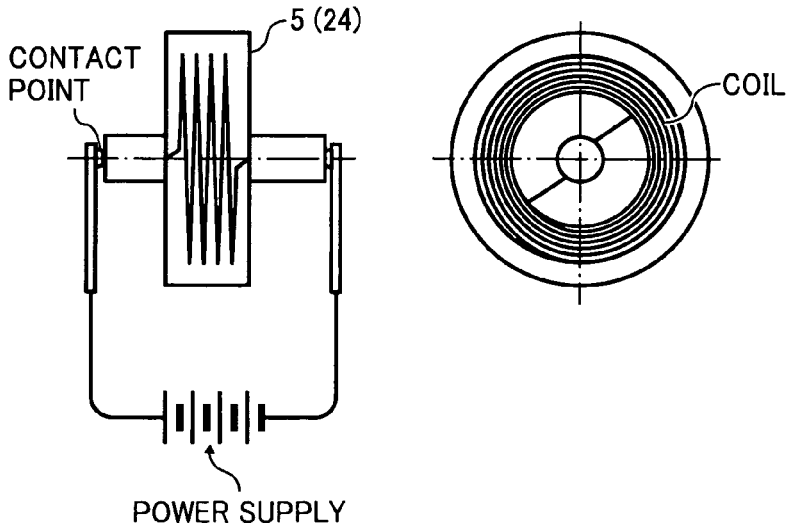
FIG. 5 is a schematic view of a configuration in which an electromagnet is arranged within a support roller.

Moreover, as the roll paper rotation controller, another configuration can be considered in terms of magnetic effect. As shown in FIG. 5, an electromagnet is set in the front roller 5, or in the front roller 5 and the rear roller 24. At the same time, as described above, the rewinding roller 4 is made of steel, and steel is, for example, wrapped around the outer perimeter of the flange member 1. As a result of electrical current flowing to the electromagnet being controlled and magnetic intensity being controlled, rotation controlling force can be generated as required, in addition to the flange member 1 being prevented from bouncing and the like during operation. When electromagnetic force is intensified, magnetic attraction increases among the flange member 1, the front roller 5, the rear roller 24, and the rewinding roller 4. As a result, the electromagnetic force can serve as braking force.

In this manner, each flange member is supported by at least two support rollers, such as to rotate freely. Therefore, two support rollers form a set for each of the two flange members fitted onto each side of the roll paper. To allow handling of roll papers having different widths, at least one of the two sets of support rollers supporting the flange members is required to be allowed movement in the longitudinal direction of the roll paper. When the rewinding roller rotates in the rewinding direction, a conventionally known rotation driving mechanism can be used to drive the rewinding roller over the desired amount of continuous time. A length of the rewinding roller is set to ensure contact between the rewinding roller and the support roller, even when the two sets of support rollers are farthest apart to support a roll paper having a largest width that is expected to be used.

However, a configuration is also possible in which the rewinding roller can come into contact with and separate from the supporting roller.

According to an aspect of the present invention, the roll paper can be rewound by a desired amount, regardless of the width of the roll paper. Slack in the paper can be prevented, and paper tension can be constantly maintained. Folding and skewing of the paper can be prevented. Stable paper feeding and conveyance, and image quality can be maintained. Moreover, uneven rotation and uneven conveyance of the paper during rewinding and transporting caused by bouncing and rebounding of the flange members can be prevented. Furthermore, energy efficiency can be increased, a low-torque motor can be used, and cost can be reduced. In addition to constant contact between components during operation being actualized, problems that occur when the roll paper stops rotating can be solved. And, the overall mechanism can be simplified and made less expensive.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A recording medium transporting mechanism comprising:

a flange member attached on either side of a roll paper, the roll paper having a recording medium wound on a core cylinder, the flange member having an outer diameter smaller than a maximum outer diameter of the roll paper;

a plurality of sets of support rollers, each set of the support rollers supports a corresponding one of the flange members in a rotatable manner, at least one set of support rollers is configured to move in a longitudinal direction of the roll paper, and a sum of outer diameters of the flange member and the corresponding support roller is greater than a maximum outer diameter of the roll paper;

a paper feed roller configured to feed the recording medium in a feeding direction from the roll paper via the support rollers; and a rewinding roller having a length greater than or equal to a maximum distance between one set of support rollers and another set of support rollers, engaging with one support roller of the one set, and configured to rotate the flange member in a rewinding direction reversed to the feeding direction.

2. The recording medium transporting mechanism according to claim 1, further comprising;

a one-way clutch configured to transmit a driving force to the rewinding roller when the rewinding roller rotates in the rewinding direction and not transmit the driving force to the rewinding roller when the rewinding roller rotates in an opposite direction to the rewinding direction.

3. The recording medium transporting mechanism according to claim 2, wherein the paper feed roller is configured to rotate in a forward direction and a reverse direction, and driving force from the paper feed roller is transmitted to the rewinding roller.

4. The recording medium transporting mechanism according to claim 3, further comprising:

an electromagnet provided to the support roller that is engaged with the rewinding roller and to perform a breaking operation on the support roller; and a braking controlling unit configured to control magnetic intensity and timing of the braking operation performed by the electromagnet.

5. The recording medium transporting mechanism according to claim 1, wherein a magnetic force is applied between the rewinding roller and the support rollers and between the support rollers and the flange member.

6. The recording medium transporting mechanism according to claim 1, further comprising:

a braking member configured to perform a breaking operation on the flange member; and a braking controlling unit configured to control intensity and timing of the braking operation performed by the braking member.

7. An image forming apparatus comprising: an image forming unit configured to form an image on a recording medium; and a recording medium transporting mechanism configured to provide the recording media to the image forming unit, the recording medium transporting mechanism including:

a flange member attached on either side of a roll paper, the roll paper having the recording medium wound on a core cylinder, the flange member having an outer diameter smaller than a maximum outer diameter of the roll paper;

a plurality of sets of support rollers, each set of the support rollers supports a corresponding one of the flange members in a rotatable manner, at least one set of support rollers is adapted configured to move in a longitudinal direction of the roll paper, and a sum of outer diameters of the flange member and the corresponding support roller is greater than a maximum outer diameter of the roll paper;

a paper feed roller configured to feed the recording medium in a feeding direction from the roll paper via the support rollers; and a rewinding roller having a length greater than or equal to a maximum distance between one set of support rollers and another set of support rollers, engaging with one support roller of the one set, and configured to rotate the flange member in a rewinding direction reversed to the feeding direction.

8. The image forming apparatus according to claim 7, wherein the recording medium transporting mechanism further includes a one-way clutch configured to transmit a driving force to the rewinding roller when the rewinding roller rotates in the rewinding direction and not transmit the driving force to the rewinding roller when the rewinding roller rotates in an opposite direction to the rewinding direction.

9. The image forming apparatus according to claim 8, wherein the paper feed roller is configured to rotate in a forward direction and a reverse direction, and driving force from the paper feed roller is transmitted to the rewinding roller.

10. The image forming apparatus according to claim 9, further comprising:

an electromagnet provided to the support roller that is engaged with the rewinding roller and to perform a breaking operation on the support roller; and a braking controlling unit configured to control magnetic intensity and timing of the braking operation performed by the electromagnet.

11. The image forming apparatus according to claim 7, wherein a magnetic force is applied between the rewinding roller and the support rollers and between the support rollers and the flange member.

12. The image forming apparatus according to claim 7, further comprising:

a braking member configured to perform a breaking operation on the flange member; and a braking controlling unit that configured to control intensity and timing of the braking operation performed by the braking member.

13. A recording medium transporting mechanism comprising:

a paper holding means for holding a roll paper attached on either side of the roll paper, the roll paper having a recording medium wound on a core cylinder, the paper holding means having a diameter smaller than a maximum outer diameter of the roll paper;

a plurality of sets of paper supporting means for supporting a corresponding one of the paper holding means in a rotatable manner, at least one set of paper supporting means is configured to move in a longitudinal direction of the roll paper, and a sum of outer diameters of the paper holding means and the corresponding paper supporting means is greater than a maximum outer diameter of the roll paper;

a paper feeding means for feeding the recording medium in a feeding direction from the roll paper via the paper supporting means; and a paper rewinding means for rewinding the recording media fed, the paper rewinding means having a length greater than or equal to a maximum distance between one set of paper supporting means and another set of paper supporting means, engaging with one paper supporting means of the one set, and being configured to rotate the paper holding means in a rewinding direction reversed to the feeding direction.

14. The recording medium transporting mechanism according to claim 13, further comprising:

a one-way clutch means for transmitting a driving force to the paper rewinding means when the paper rewinding means rotates in the rewinding direction and not transmitting the driving force to the paper rewinding means when the paper rewinding means rotates in an opposite direction to the rewinding direction.

15. The recording medium transporting mechanism according to claim 14, wherein the paper feeding means is configured to rotate in a forward direction and a reverse direction, and driving force from the paper feeding means is transmitted to the paper rewinding means.

16. The recording medium transporting mechanism according to claim 15, further comprising:

an electromagnet means provided to the paper supporting means that is engaged with the paper rewinding means and for performing a braking operation on the paper supporting means; and a braking controlling means for controlling magnetic intensity and timing of the braking operation performed by the electromagnet means.

17. The recording medium transporting mechanism according to claim 13, wherein a magnetic force is applied between the paper rewinding means and the paper supporting means and between the paper supporting means and the paper holding means.

18. The recording medium transporting mechanism according to claim 13, further comprising:

a braking means for performing a breaking operation on the paper holding means; and a braking controlling means for controlling intensity and timing of the braking operation performed by the braking means.

* * * * *